US005102567A

United States Patent [19]

Wolf

[11] Patent Number: 5,102,567

[45] Date of Patent: Apr. 7, 1992

[54] HIGH PERFORMANCE FOOD-GRADE LUBRICATING OIL

[75] Inventor: Leslie R. Wolf, Bolingbrook, Ill.

[73] Assignee: Amoco Corporation, Chicago, Ill.

[21] Appl. No.: 555,767

[22] Filed: Jun. 25, 1990

[51] Int. Cl.[5] ..... C10M 135/00; C10M 133/00; C10M 129/00

[52] U.S. Cl. ..... 252/46.6; 252/49.8; 252/50; 252/52 R; 252/56 R; 252/51.5 A; 252/49.9; 252/52 A

[58] Field of Search ..... 252/46.6, 49.8, 50, 252/52 R, 56 R; 208/18

[56] References Cited

U.S. PATENT DOCUMENTS

| | | | |
|---|---|---|---|
| 519,980 | 5/1894 | Winter | 462/999 |
| 2,988,506 | 6/1961 | Sproule et al. | 252/40.7 |
| 3,271,311 | 9/1966 | Morway et al. | 252/25 |
| 3,773,665 | 11/1973 | Braid | 252/50 |
| 3,873,466 | 3/1975 | Wright | 426/610 |
| 4,062,785 | 12/1977 | Nibert | 252/49.6 |
| 4,077,911 | 3/1978 | Okumura et al. | 252/550 |
| 4,210,553 | 7/1980 | Trenkle et al. | 252/174.11 |
| 4,298,481 | 11/1981 | Clarke | 252/21 |
| 4,673,530 | 6/1987 | Hara | 252/398 |

*Primary Examiner*—Margaret Medley

*Attorney, Agent, or Firm*—Thomas A. Yassen; William H. Magidson; Ralph C. Medhurst

[57] ABSTRACT

An improved high performance food grade lubricating oil is provided that effectively lubricates bearings, gears, and slide mechanisms present in food industry equipment. The food grade oil provides superior oxidation, thermal, and hydrolytic stability properties and is economic to manufacture. In the preferred form, the lubricating oil includes a base oil and an additive package comprising the combination of phenolic and aromatic amine antioxidants.

20 Claims, No Drawings

HIGH PERFORMANCE FOOD-GRADE LUBRICATING OIL

BACKGROUND OF THE INVENTION

1. Field of the Invention

This invention relates to lubricants and, more particularly to food grade lubricating oils which are especially useful as hydraulic oils, gear oils, and compressor oils for equipment in the food service industry.

2. Background

The equipment used in the food processing industry varies by segment with the three leading segments comprising meat and poultry, beverages, and dairy. While the equipment varies from segment to segment, the moving parts such as bearings, gears, and slide mechanisms are similar and often require lubrication. The lubricants most often used include hydraulic, refrigeration, and gear oils as well as all-purpose greases. These food industry oils must meet more stringent standards than other industry lubricants.

Due to the importance of ensuring and maintaining safeguards and standards of quality for food products, the food industry must comply with the rules and regulations set forth by the United States Department of Agriculture (USDA). The Food Safety and Inspection Service (FSIS) of the USDA is responsible for all programs for the inspection, grading, and standardization of meat, poultry, eggs, dairy products, fruits, and vegetables. These programs are mandatory, and the inspection of non-food compounds used in federally inspected plants is required.

The FSIS is custodian of the official list of authorized compounds for use in federally inspected plants. The official list (see page 11-1, List of Proprietary Substances and Non-Food Compounds, Miscellaneous Publication Number 1419 (1989) by the Food Safety and Inspection Service, United States Department of Agriculture) states that lubricants and other substances which are susceptible to incidental food contact are considered indirect food additives under USDA regulations. Therefore, these lubricants, classified as either H-1 or H-2, are required to be approved by the USDA before being used in food processing plants. The most stringent classification, H-1, is for lubricants approved for incidental food contact. The H-2 classification is for uses where there is no possibility of food contact and assures that no known poisons or carcinogens are used in the lubricant. The present invention pertains to a H-1 approved lubricating oil. H-1 approved oil and the term "food grade" will be used interchangeably for purpose of this application.

Several market factors accentuate the need for a superior food grade lubricating oil. Some manufacturers prefer to use only H-1 approved oils to avoid the threat of noncompliance. Reducing contamination risks and inventory carrying costs associated with stocking multiple inventories of varying viscosity/FDA approval level oils also provides an economic incentive for exclusive use of H-1 approved oils. Furthermore, other firms, reliant upon company image as a marketing resource, may elect to take the conservative approach to health and safety issues and utilize only H-1 approved oils. All of the above concerns are addressed by the exclusive use of H-1 approved oils.

In addition to meeting the requirements for safety set by federal regulatory agencies, the product must be an effective lubricant. Lubricating oils for food processing plants should lubricate machine parts, resist viscosity change, resist oxidation, protect against rusting and corrosion, provide wear protection, prevent foaming, and resist the formation of sludge in service. The product should also perform effectively at various lubrication regimes ranging from hydrodynamic thick film regimes to boundary thin film regimes.

The oxidation, thermal, and hydrolytic stability characteristics of a lubricating oil help predict how effectively an oil will maintain its lubricating properties over time and resist sludge formation. Hydrocarbon oils are partially oxidized when contacted with oxygen at elevated temperatures for prolonged periods of time. The oxidation process produces acidic bodies within the lubricating oil which are corrosive to metals often present in food processing equipment. Many metals present in food processing equipment and in contact with both the oil and the air are effective oxidation catalysts which further increases the rate of oxidation. Oxidation products contribute to the formation of sludges which can clog valves, plug filters, and result in the over-all breakdown of the viscosity characteristics of the lubricant. Under some circumstances, sludge formation can result in pluggage, complete loss of oil system flow, and failure or damage to machinery.

The thermal and hydrolytic stability characteristics of a lubricating oil reflect primarily on the stability of the lubricating oil additive package. The stability criteria monitor sludge formation, viscosity change, acidity change, and the corrosion tendencies of the oil. Hydrolytic stability assesses these characteristics in the presence of water. Inferior stability characteristics result in a lubricating oil that loses lubricating properties over time and precipitates sludge.

It is, therefore, desirable to provide an improved food grade lubricating oil which overcomes most, if not all, of the preceding problems.

SUMMARY OF THE INVENTION

An improved high performance food grade lubricating oil is provided which is particularly useful for lubrication of bearings, gears, and slide mechanisms in food industry equipment. The novel food grade lubricating oil displayed unexpectedly and surprisingly good oxidation, thermal, and hydrolytic stability results over prior art food grade lubricating oils. Advantageously, the novel food grade oil meets and exceeds all requirements necessary for incidental food contact (H-1) approval as determined by the USDA. It also provides superior freedom from sludging, rust and corrosion protection, and foam resistance. The new food grade lubricating oil is also economical to manufacture.

To achieve these objectives, the high performance food grade lubricating oil comprises a base oil and a sufficient amount of an additive package to impart extreme oxidation resistance properties to the lubricating oil comprising phenolic and aromatic amine antioxidants.

It has been found that the combination of phenolic and aromatic amine antioxidants in food grade lubricating oils complement each other resulting in a combination having properties far superior to either additive alone or the prior art food grade oils. In the present invention, the total amount by weight of phenolic and aromatic amine antioxidant necessary to impart the desired degree of oxidation resistance is significantly less than either antioxidant independently.

DETAILED DESCRIPTION OF THE PREFERRED EMBODIMENTS

A high performance composite lubricating oil is provided to lubricate parts such as bearings, gears, and slide mechanisms particularly in food processing equipment. The food grade lubricating oil provides outstanding oxidation, thermal, and hydrolytic stability; protects against rusting and corrosion; provides wear protection; prevents foaming; and resists the formation of sludge.

BASE OIL

The base oil for use in the present high performance food grade lubricating oil can comprise food grade hydrocarbon oils such as food grade mineral oil, food grade polybutene, food grade hydrogenated polybutene, food grade polyolesters, food grade diesters, and food grade hydrogenated poly(alpha olefin) with an alpha olefin monomer of not less than 6 carbon atoms. The base oil should be substantially odorless, colorless, and tasteless and comply with the USDA H-1 specifications and requirements for use in processing plants where incidental contact with food may occur.

The base oil for use in the present high performance food grade lubricating oil can be a mineral oil such as a technical grade white oil made from select lubricant base stocks. The food grade mineral oil can also be a white mineral oil which meets the more stringent requirements of the United States Pharmacopeia (USP) or a light mineral oil which meets the more stringent requirements of the National Formulary (NF). These food grade mineral oils are often directly derived from crude oil through the processing steps of distillation, extraction, dewaxing, and severe hydrotreating. Suitable base oils, derived from other means are food grade polybutene, food grade hydrotreated polybutene, food grade polyolesters, food grade diesters, and food grade hydrogenated poly(alpha olefin) with an alpha olefin monomer of not less than 6 carbon atoms.

Base oil thickener components such as food grade polybutene and food grade hydrotreated polybutene can be added to the base oil to adjust the product viscosity while maintaining a high quality viscosity index (VI). Viscosity index is a measure of the viscosity-temperature behavior of an oil wherein the higher the viscosity index, the smaller the change in viscosity as the temperature of the oil is increased or decreased. Thickeners such as food grade polybutene can be injected into the base oil as a smaller dose of a high viscosity material such as Indopol H1500 Polybutene (121,000 CS at 40° C. and 3000 CS at 100° C.) produced by Amoco Chemical Company or as a larger dose of a lower viscosity material such as Indopol L-14 (27 CS at 40° C. and 4.7 CS at 100° C.) produced by Amoco Chemical Company. Smaller doses of higher viscosity polybutene such as H1500 provide better antioxidation results and are preferred over larger doses of lower viscosity polybutene (L-14). For purposes of this application, the thickener is included in the base oil component of the high performance food grade lubricating oil.

The preferred base oil comprises about 98.0% to 99.8% by weight of the high performance food grade lubricating oil and includes blends of food grade mineral oil and a thickener such as polybutene to produce a product ranging in viscosity from 10 CS at 40° C. to 1000 CS at 40° C.

ANTI-OXIDANT ADDITIVES

The superior antioxidation package in the present invention comprises the combination of food grade phenolic and aromatic amine antioxidants. The total amount by weight of phenolic and aromatic amine antioxidant necessary to impart the desired degree of oxidation resistance is significantly less than either antioxidant independently.

The class of phenolic antioxidants which can be employed in the practice of this invention include food grade, oil-soluble, sterically hindered phenols and thiophenols. Included within the definition of phenolic and thiophenolic antioxidants are sterically hindered phenolics such as hindered phenols and bis-phenols, hindered 4,4'-thiobisphenols, hindered 4-hydroxy-and 4-thiolbenzoic acid esters and dithio esters, and hindered bis(4-hydroxy-and 4-thiolbenzoic acid and dithio acid) alkylene esters. The sterically hindered phenols are the preferred phenolic antioxidants.

For purposes of this invention, the sterically hindered phenolics have the basic groups:

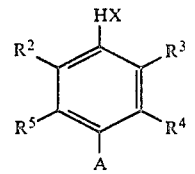

wherein X is sulfur or oxygen, preferably oxygen; $R^2$ and $R^3$ are alkyl groups which sterically hinder the HX group and preferably have from 3 to 10 carbons and are usually branched-chain; $R^4$ and $R^5$ are the same or different substituents selected from hydrogen or a $C_1$ to $C_4$ alkyl, preferably hydrogen; and A is defined below.

The phenolic moiety is substituted in both positions ortho to the hydroxy or thiol groups with alkyl groups which sterically hinder these groups. Such alkyl substituents usually have 3 to 10 carbons, preferably 4 to 8 carbons, one generally branched rather than straight-chain (e.g., t-butyl, t-amyl, etc.).

The first group of hindered phenolic antioxidants is the single hindered phenols. In this case, A in the above formula is hydrogen or a $C_1$ to $C_{10}$ alkyl group. Examples of such compounds include 2,6-bi-tert-butylphenol, 2,6-di-tert-butyl-p-cresol, 2,6-di-tert-amyl-p-cresol, and 2-tert-butyl-6-tert-amyl-p-cresol.

A second group of hindered phenolic antioxidants is the hindered bisphenols. In this case, A is a bond to another basic phenolic group, preferably through an intervening methylene or alkylidene group of from 2 to 4 carbon atoms. Examples of these compounds include 4,4'-methylene bis(2,6-bi-tert-butylphenol), 4,4'-dimethylene bis(2,6-di-tert-butyl phenol), 4,4'-trimethylene bis(2,2-di-tert-amyl phenol), and 4,4'-trimethylene bis(2,6-di-tert-butyl phenol).

Another group of hindered phenolic antioxidants is the hindered 4,4'-thio bis-phenols, i.e., where A in the formula is sulfur connected to another phenolic group. Examples of these compounds include 4,4'-thio bis(2,6-di-sec-butyl phenol), 4,4'-thio bis(2-tert-butyl-6-isopropyl phenol), and 4,4'-thio bis(2-methyl-6-t-butyl phenol).

A fourth group of hindered phenolic antioxidants is 4 alkoxy phenols, where A in the above formula is —$OR^6$ and where $R^6$ is a substituent selected from the group consisting of H and $C_1$ to $C_8$ alkyls. Examples of these compounds include butylated hydroxy anisole, butylated hydroxy phenetole, and butylated hydroquinone. Any of the above compounds, with H-1 approval, would be a suitable phenolic antioxidant.

The preferred food grade phenolic antioxidant is butylated hydroxy toluene (BHT). Butylated hydroxy toluene is cost effective, commercially available, and is H-1 approved. Butylated hydroxy toluene is preferably present in the high performance food grade lubricating oil in an amount less than 1% by weight and most preferably is present in an amount of 0.3% by weight of the high performance food grade lubricating oil for best results.

Suitable food grade, oil-soluble aromatic amine antioxidants are naphthyl phenyl amines, alkylated phenyl naphthyl amines, and alkylated diphenyl amines. The preferred aromatic amines have the basic structure:

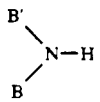

where B and $B^1$ are the same or different substituents selected from:

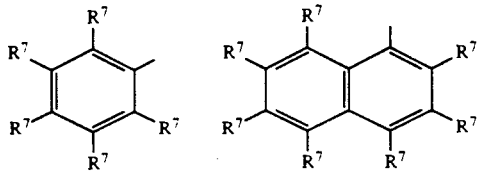

where $R^7$ is the same or different substituents selected from H or $C_1$ to $C_{18}$ alkyls.

Examples of aromatic amine antioxidants included within the above formula include the napthylamines such as N-phenyl-alpha-naphthylamine, N-p-methylphenyl-alpha-naphthylamine, and the diphenylamines such as disec butyldiphenylamine, di-isobornyl-diphenylamine, and dioctyldiphenylamine. Any of the above compounds, with H-1 approval, would be a suitable aromatic amine antioxidant.

The preferred food grade aromatic amine antioxidants are the alkylated diphenyl amines. In the present invention, the food grade aromatic amine is the reaction products of the alkylation of n-phenylbenzenamine and 2,4,4 trimethyl pentene. The resultant product of this alkylation is a mixture of ortho, meta, and para bis(octyl phenyl)amine. Bis(octyl phenyl)amine can also be referred to as dioctyl diphenyl amine and is a food grade amine. A suitable food grade aromatic amine for the present invention is IRGANOX L-57, manufactured by CIBA-GEIGY Corporation. In the present invention, the aromatic amine can comprise less than 1% by weight of the high performance food grade lubricating oil and, in the preferred form comprises about 0.07% by weight of the high performance food grade lubricating oil for best results.

The phenolic and aromatic amine combination can range in ratio by weight from 20:1 to 1:20 although the preferred ratio ranges from 4:1 to 1:1. Oxidation stability performance is superior and fairly consistent over the preferred ratio range. The present invention has a phenolic to aromatic amine weight ration of 4:1 since the aromatic amine is more expensive and, at higher levels, has a greater tendency to create sludge.

ANTI-RUST ADDITIVES

The superior anti-rust additive package comprises a combination of food grade ionic and non-ionic surface active anti-rust ingredients. The total amount by weight of ionic and non-ionic surface active anti-rust additive necessary to impart the desired degree of rust resistance is significantly less than either anti-rust additive independently.

Ionic anti-rust lubricating additives which may be employed in the composition of the present invention include food grade phosphoric acid, mono and dihexyl ester compounds with tetramethyl nonyl amines, and $C_{10}$ to $C_{18}$ alkyl amines of the form:

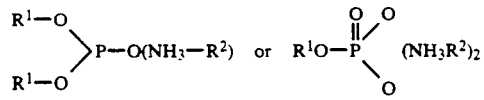

where $R^1$ is a $C_1$ to $C_8$ alkyl and $R^2$ is a $C_{10}$ to $C_{18}$ alkyl. Any compound of the above form, with H-1 approval, would be a suitable anti-rust additive.

The preferred food grade ionic anti-rust additive is an alkyl amine phosphate which conforms to the diester formulation above where $R_1$ is a $C_6$ alkyl and $R_2$ is a $C_{13}$ alkyl. A suitable food grade ionic anti-rust lubricating additive for the present invention is IRGALUBE 349 manufactured by CIBA-GEIGY Corporation. In the present invention, the food grade ionic surface active additive can comprise less than 1% by weight of the high performance food grade lubricating oil and, in the preferred form, comprises about 0.10% by weight of the food grade lubricating oil for best results.

Non-ionic anti-rust lubricating additives which may be employed in the composition of the present invention include food grade fatty acids and their esters formed from the addition of sorbitan, glycerol, or other polyhydric alcohols, or polyalkylene glycols. Other non-ionic anti-rust lubricating additives can include food grade ethers from fatty alcohols alkoxylated with alkylene oxides, or sorbitan alkoxylated with alkylene oxides, or sorbitan esters alkoxylated with alkylene oxides.

Examples of suitable food grade non-ionic anti-rust lubricating additives include: sorbitan mono-oleate, ethoxylated vegetable oil, ethoxylated fatty acids, ethoxylated fatty alcohols, fatty glyceride esters, polyoxyethylene sorbitan mono-oleate, polyoxyethylene sorbitan, glycerol mono-oleate, glycerol di-oleate, glycerol mono-stearate, and glycerol di-stearate. Any of the above compounds, with H-1 approval, would be a suitable anti-rust additive.

The preferred food grade non-ionic anti-rust lubricating oil additive is sorbitan mono-oleate for best results. A suitable grade of sorbitan mono-oleate is SPAN 80, manufactured by Atlas Chemicals. In the present invention, the food grade non-ionic surface active anti-rust additive can comprise less than 1% by weight of the high performance food grade lubricating oil and, in the preferred form, will comprise about 0.05% by weight of the high performance food grade lubricating oil. Increasing the sorbitan mono-oleate concentration above 0.10% by weight can detrimentally effect the demulsibility (water separation) characteristics of the high performance food grade lubricating oil. Lowering the sorbitan mono-oleate concentration below 0.01% by weight can detrimentally effect the anti-rust qualities of the oil.

ANTI-WEAR ADDITIVES

Anti-wear additives which may be employed in the composition of the present invention include food grade oil-soluble sulfur and/or phosphorus containing compounds. A compound which meets the above criteria is triphenyl phosphorothioate. Other sulfur and/or phosphorus containing materials which are not currently approved for food grade use include: zinc dialkyl dithiophosphate, zinc dithiocarbamate, amine dithiocarbamate, and methylene bis dithiocarbamate. Any of the above compounds, with H-1 approval, would be a suitable anti-wear additive.

The preferred food grade anti-wear lubricating oil additive is triphenyl phosphorothioate. A suitable grade of triphenyl phosphorothioate is IRGALUBE TPPT, manufactured by CIBA-GEIGY Corporation. In the present invention, the food grade anti-wear additive can comprise less than 1% by weight of the high performance food grade lubricating oil and, in the preferred form, comprises about 0.30% by weight of the high performance food grade lubricating oil.

The preferred high performance food grade lubricating oil comprises by weight: 98% to 99.8% food grade base oil comprising food grade mineral oil and optionally food grade polybutene, and 0.05% to 2.0% antioxidant additives including (a) a food grade alkylated diphenyl amine antioxidant and (b) butylated hydroxy toluene or butylated hydroxy anisole. The antioxidant additives are present in the lubricating oil in a ratio range by weight of 4:1 to 1:1. Preferably, the lubricating oil also includes from 0.01% to 1.0% food grade anti-wear and anti-rust additives comprising an ionic surface active anti-rust component and a non-ionic surface active anti-rust component including at least one member selected from the group containing fatty acids and their esters formed from the addition of polyhydric alcohols, fatty acids and their esters formed from the addition of polyalkylene glycols, ethers from alcohols alkoxylated with alkylene oxides, or sorbitan alkoxylated with alkylene oxides.

EXAMPLES

The following examples illustrate the practice of specific embodiments of this invention and comparison cases. These examples should not be interpreted as limitations of the scope of this invention.

EXAMPLE 1

A food grade lubricating oil was prepared in a beaker by adding:

a) 99.25% by weight of a base oil comprising by weight, 95% of a food grade mineral oil with a viscosity of 70 CS at 40° C. and 5% of a food grade high viscosity (2800 CS at 100° C.) polybutene thickener,
b) 0.30% by weight of triphenyl phosphorothioate,
c) 0.10% by weight of an alkyl amine phosphate (IRGALUBE 349)
d) 0.05% by weight Sorbitan mono-oleate (SPAN 80), and
e) 0.30% by weight butylated hydroxy toluene (BHT). The food grade lubricating oil of Example 1 did not include bis(octyl phenyl) amine. The food grade lubricating oil was mixed for 20 minutes at a temperature of 82° C.

The anti-oxidation properties of the food grade lubricating oil were measured using the ASTM D4871 universal oxidation test. All ASTM Test procedures are from the 1989 Annual Book of ASTM Standards published by ASTM. ASTM D4871 measures the period of time in hours required for the lubricant to reach a neutralization number of 2.0 mg KOH/g oil at 149° C. The results are as follows:

| | |
|---|---|
| Butylated Hydroxy Toluene, weight % | 0.30 |
| Bis(Octyl Phenyl) amine, weight % | 0.00 |
| D4871, hours to reach 2.0 NEUT. | 53.5 |

EXAMPLE 2

A food grade lubricating oil was prepared in manner similar to Example 1, except that the base oil was decreased to 99.12% by weight, the butylated hydroxy toluene decreased to 0.20% by weight, and bis(octyl phenyl)amine was added in an amount of 0.23% by weight (based on the total weight of the food grade lubricating oil). The synergistic combination of phenolic and aromatic amine antioxidants improved the D4871 result over Example 1.

| | |
|---|---|
| Butylated Hydroxy Toluene, weight % | 0.20 |
| Bis(Octyl Phenyl) amine, weight % | 0.23 |
| D4871, hours to reach 2.0 NEUT. | 114.8 |

EXAMPLE 3

A food grade lubricating oil was prepared in a manner similar to Example 2, except that the butylated hydroxy toluene was decreased to 0.00% by weight and the bis(octyl phenyl)amine was increased to 0.30% by weight. Elimination of one of the two synergistic components resulted in inferior anti-oxidation properties to Example 2 and comparable results to Example 1.

| | |
|---|---|
| Butylated Hydroxy Toluene, weight % | 0.00 |
| Bis(Octyl Phenyl) amine, weight % | 0.30 |
| D4871, hours to reach 2.0 NEUT. | 56.8 |

EXAMPLE 4

A food grade lubricating oil was prepared in a manner similar to Example 2, except that the base oil was decreased to 99.5% by weight, the triphenyl phosphorothioate increased slightly to 0.32% by weight, the alkyl amine phosphate increased slightly to 0.11% by weight, the butylated hydroxy toluene reduced to 0.29% by weight, and the bis(octyl phenyl)amine increased to 0.08% by weight. Changing the phenolic to aromatic amine antioxidant ratio by weight to 3.6:1 greatly improved anti-oxidation properties over the independent antioxidant Examples 1 and 3 and slightly improved anti-oxidation properties over the 0.9:1 synergistic Example 2.

| | |
|---|---|
| Butylated Hydroxy Toluene, weight % | 0.29 |
| Bis(Octyl Phenyl) amine, weight % | 0.08 |
| D4871, hours to reach 2.0 NEUT. | 122.1 |

EXAMPLE 5

A food grade lubricating oil was prepared in a beaker by adding: a) 99.7% by weight of a base oil comprising by weight, 94.5% of a food grade mineral oil with a viscosity of 70 CS at 40° C., 5.00% of a food grade high viscosity (2800 CS at 100° C.) polybutene thickener, 0.30% triphenyl phosphorothioate, 0.10% of an alkyl amine phosphate (IRGALUBE 349), and 0.05% sorbitan mono-oleate (SPAN 80); and b) 0.30% by weight butylated hydroxy toluene. The food grade lubricating oil of Example 5 did not include bis(octyl phenyl)amine. The food grade lubricant oil was mixed for 20 minutes at a temperature of 82° C.

The anti-oxidation properties of the food grade lubricating oil were measured using the ASTM D943 turbine oil stability test which, similarly to the ASTM D4871 test, measures the period of time in hours required for the lubricant to reach a neutralization number of 2.0 mg KOH/g oil. The ASTM D943 test, however, is less severe, operating at 95° C. instead of 149° C. requiring more execution time. The results were as follows:

| | |
|---|---|
| Butylated Hydroxy Toluene, weight % | 0.30 |
| Bis(Octyl Phenyl) amine, weight % | 0.00 |
| D943, hours to reach 2.0 NEUT. | 1284 |

EXAMPLE 6

A food grade lubricating oil was prepared in a manner similar to Example 5, except that the butylated hydroxy toluene was decreased to 0.24% by weight and the bis(octyl phenyl)amine was added in an amount of 0.06% by weight (based on the total weight of the food grade lubricating oil). The synergistic combination of phenolic and aromatic amine antioxidants in a ratio by weight of 4:1 improved the D943 result substantially over Example 5.

| | |
|---|---|
| Butylated Hydroxy Toluene, weight % | 0.24 |
| Bis(Octyl Phenyl) amine, weight % | 0.06 |
| D943, hours to reach 2.0 NEUT. | >4850 |

The sample in Example 6 had not exceeded a neutralization number of 2.0 after 4850 hours and was taken off-line.

EXAMPLE 7

A food grade lubricating oil was prepared in a manner similar to Example 6, except that the butylated hydroxy toluene was decreased to 0.15% by weight and the bis(octyl phenyl)amine was increased to 0.15% by weight. The synergistic combination of phenolic and aromatic amine antioxidants in a ratio by weight of 1:1 improved the D943 result substantially over Example 5 and at least comparably to Example 6.

| | |
|---|---|
| Butylated Hydroxy Toluene, weight % | 0.15 |
| Bis(Octyl Phenyl) amine, weight % | 0.15 |
| D943, hours to reach 2.0 NEUT. | >9600 |

The sample in Example 7 had not exceeded a neutralization number of 2.0 after 9600 hours and was taken off line.

EXAMPLE 8

A superior high performance food grade lubricating oil was prepared in a beaker by adding: a) 99.338% by weight of a base oil comprising by weight, 84.30% of a food grade mineral oil with a viscosity of 30 CS at 40° C. and 15.70% of a food grade mineral oil with a viscosity of 70 CS at 40° C., b) 0.23% by weight of triphenyl phosphorothioate, c) 0.10% by weight of an alkyl amine phosphate, d) 0.042% by weight sorbitan mono-oleate, e) 0.23% by weight of butylated hydroxy toluene, and f) 0.06% by weight bis(octyl phenyl)amine. The performance properties of the food grade oil of Example 8 are listed in Table 1.

EXAMPLE 9

A superior high performance food grade lubricating oil was prepared in a manner similar to Example 8, except that the viscosity of the blend was increased by increasing the base oil concentration of food grade mineral oil with a viscosity of 70 CS at 40° C. to 56.70% by weight and decreasing the concentration of food grade mineral oil with a viscosity of 30 CS at 40° C. to 43.30% by weight. The performance properties of the food grade lubricating oil of Example 9 are listed in Table 1.

EXAMPLE 10

A superior high performance food grade lubricating oil was prepared in a manner similar to Example 9, except that the viscosity of the blend was further increased by increasing the base oil concentration of food grade mineral oil with a viscosity of 70 CS at 40° C. to 98.00% by weight and decreasing the concentration of food grade mineral oil with a viscosity of 30 CS at 40° C. to 2.00% by weight. The performance properties of the food grade oil of Example 10 are listed in Table 1.

EXAMPLE 11

A superior high performance food grade lubricating oil was prepared in a manner similar to Example 10, except that the viscosity of the blend was further increased by decreasing the base oil concentration of food grade mineral oil with a viscosity of 70 CS at 40° C. to 95.00% by weight and adding 5.00% by weight of a food grade polybutene with a viscosity of 121,000 CS at 40° C. The performance properties of the food grade oil of Example 11 are listed in Table 1.

TABLE 1

FOUR SUPERIOR HIGH PERFORMANCE FOOD-GRADE LUBRICATING OILS

| Property | Examples 8 | 9 | 10 | 11 |
|---|---|---|---|---|
| Gravity, °API(D287) | 33.1 | 31.9 | 30.7 | 30.5 |
| Specific Gravity | 0.860 | 0.866 | 0.872 | 0.874 |
| Flash Point, COC, | | | | |
| °C. (D92) | 210 | 215 | 224 | 242 |
| °F. | 410 | 420 | 435 | 468 |
| Pour Point, | | | | |
| °C. (D97) | −12 | −12 | −9 | −9 |
| °F. | 10 | 10 | 15 | 15 |
| Viscosity (D445) | | | | |
| 40° C., cSt | 32.47 | 45.81 | 65.81 | 98.67 |
| 100° C., cSt | 5.40 | 6.70 | 8.38 | 11.46 |
| 100° F., SUS | 168 | 236 | 340 | 514 |
| 210° F., SUS | 44.4 | 48.7 | 54.4 | 65.6 |
| Viscosity Index (D2270) | 100 | 98 | 96 | 103 |
| NEUT., mg KOH/g oil (D974) | 0.16 | 0.17 | 0.17 | 0.15 |
| Color (D1500) | colorless | colorless | colorless | colorless |

TABLE 1-continued

FOUR SUPERIOR HIGH PERFORMANCE FOOD-GRADE LUBRICATING OILS

| Property | Examples 8 | 9 | 10 | 11 |
|---|---|---|---|---|
| Copper Strip (D 130) 121° C., 3 hours | 1-A | 1-A | 1-A | 1-A |
| Demulsibility, (D1401)(1) | | | | |
| mins to 3 ml emulsion | 15 | 24 | 20 | 10 |
| mins to 0 ml emulsion | 16 | 25 | 22 | 15 |
| Rust Prevention, (D665) | | | | |
| distilled water | Pass | Pass | Pass | Pass |
| synth. sea water | Pass | Pass | Pass | Pass |
| Foam, Seq. I (D892) (tend-stab), ml | 40-0 | 10-0 | 5-0 | 5-0 |

Note (1)Test run at 54° C. for all grades except 82° C. for Example 11

EXAMPLE 12

Oxidation stability tests were conducted to compare the superior anti-oxidation properties of the inventive high performance food grade lubricating oil to prior art oils. The inventive high performance food grade lubricating oil of Examples 8–11 are the control oils to which the prior art oils were compared. Oxidation stability was determined by ASTM tests ASTM D943 and ASTM D4310. The comparison properties are listed in Table 2. The prior art oil identification key for Examples 12–14 (i.e., Tables 2–4) is below.

| Competitor | Product | Table Designation |
|---|---|---|
| American Oil & Supply | PWAA 10 | Competitor A-1 |
| American Oil & Supply | PWAA 20 | Competitor A-2 |
| Chevron U.S.A. | FM Oil 32X | Competitor B-1 |
| Chevron U.S.A. | FM Oil 105X | Competitor B-2 |
| Keystone Div., Pennwalt | Nevastane 10AW | Competitor C-1 |
| Lubrication Engineers | Quinplex 4010 | Competitor D-1 |
| Lubrication Engineers | Quinplex 4030 | Competitor D-2 |
| Lubriplate | FMO 350 | Competitor E-1 |
| Lubriplate | FMO 500 | Competitor E-2 |
| Lubriplate | FMO 200-AW | Competitor E-3 |

TABLE 2

OXIDATION STABILITY COMPARISON CASE ASTM D943/4310

| Oil Tested | ASTM D943 Hours to Acid No. | ASTM D4310 Test Time Hours(1) | Neut No. End of Test | Mg Sludge End of Test |
|---|---|---|---|---|
| Example 8 Oil | 4725+ | 1000 | 0.05 | 170 |
| Example 9 Oil | 4725+ | 1000 | 0.06 | 172 |
| Example 10 Oil | 4725+ | 1000 | 0.05 | 177 |
| Example 11 Oil | 4725+ | 1000 | 0.05 | 194 |
| Prior Art Oils | | | | |
| Competitor A-1 | 24 | 66 | 13.7 | — |
| Competitor A-2 | 24 | 50 | 10.5 | 10000+ |
| Competitor B-1 | 1900 | 250 | 0.7 | visible |
| Competitor B-2 | 2087 | | | — |
| Competitor C-1 | 1500+ | 500 | 0.36 | 51 |
| | | 1500 | 0.26 | 358 |
| Competitor D-1 | 2900 | 1100 | 0.14 | 2889 |
| Competitor D-2 | 3700 | | — | — |
| Competitor E-1 | 110 | 100 | 1.29 | 411 |
| Competitor E-2 | 110 | | — | — |
| Competitor E-3 | 1000+ | 1000 | 0.20 | 1288 |

Note(1) D4310 is normally run for 1000 hours.

EXAMPLE 13

Thermal stability tests were conducted to compare the superior thermal stability properties of the inventive high performance food grade lubricating oil over prior art oils. The high performance food grade lubricating oil of Example 8 is the control oil to which the products of several prior art oils were compared. Thermal stability was determined by the Cincinnati-Milacron Thermal Stability Test (Procedure A) which was run at 135° C. for 168 hours. The comparison properties are listed in Table 3.

TABLE 3

THERMAL STABILITY COMPARISON CASE CINCINNATI-MILACRON-PROCEDURE A

| Oil Tested | Sludge mg | Copper Loss mg | Iron Loss mg | Visc. Incr. % | Acid No. Increase | Test Result |
|---|---|---|---|---|---|---|
| Cinc.-Milacron Spec. | 25 max | 10 max | 1 max | 5 max | .15 max | |
| Example 8 | 14.2 | 4.2 | 0.0 | 1.1 | 0.03 | Pass |
| Prior Art Oils | | | | | | |
| Competitor A-1 | 474.4 | 49.7 | 15.9 | 17.9 | −0.91 | Fail |
| Competitor B-1 | 70.9 | 11.3 | 0.1 | 4.3 | −0.65 | Fail |
| Competitor C-1 | 61.2 | 19.4 | 0.3 | 7.7 | −0.28 | Fail |
| Competitor D-1 | 171.6 | 63.0 | 0.0 | 8.4 | −0.85 | Fail |
| Competitor E-1 | 1.6 | 0.7 | 0.0 | 9.0 | 0.38 | Fail |
| Competitor E-3 | 157.0 | 16.5 | 0.6 | −4.0 | −0.42 | Fail |

Note: Values underlined fail to meet Cincinnati-Milacron requirements for this test.

EXAMPLE 14

Hydrolytic stability tests were conducted to compare the superior hydrolytic stability properties of the inventive high performance food grade lubricating oil over prior art oils. The high performance food grade lubricating oil of Example 8 is the control oil to which prior art oils were compared. Hydrolytic stability was determined by test ASTM D2619, which was run at 95° C. for 48 hours. The comparison properties are listed in Table 4.

TABLE 4

HYDROLYTIC STABILITY COMPARISON CASE ASTM D2619

| Oil Tested | Copper Loss Mg(3) | Copper Strip Rating(2)(3) | Acid Number Increase |
|---|---|---|---|
| Example 8 | 3.2 | 1-A | 0.01 |
| Prior Art Oils | | | |
| Competitor A-1 | 16.3 | 2-C | 0.31 |
| Competitor A-2 | 13.1 | 2-C | 1.03 |
| Competitor B-1 | 3.2 | 2-A/2-B | −0.23(1) |
| Competitor B-2 | 2.9 | 2-B | −0.14(1) |
| Competitor C-1 | 3.4 | 2-C | −0.24(1) |
| Competitor D-1 | 3.7 | 1-B | −0.28(1) |
| Competitor D-2 | 2.0 | 1-B | −0.29(1) |
| Competitor E-1 | 0.9 | 1-B/2-A | 0.005 |
| Competitor E-3 | 2.4 | 1-B/2-A | −0.32(1) |

Note (1)A negative number indicates the acid number was lower at the end of the test than the initial value.
Note (2)Denotes the color of the D2619 metal specimen after the test using ASTM D130 scale.
Note (3)Increase in copper loss and higher copper strip numbers indicate corrosion.

That which is claimed is:

1. A high performance food grade lubricating oil comprising:

a. food grade base oil substantially complying with USDA H-1 specifications for use in processing plants where incidental contact with food may occur, said food grade base oil comprising a substantially odorless, colorless, and tasteless food grade hydrocarbon oil selected from the group consisting of food grade mineral oil, food grade polybutene, and food grade poly(alpha olefin), and b. a sufficient amount of a food grade additive package to impart extreme oxidation resistance properties to said food grade lubricating oil, said food grade additive package comprising a food grade phenolic antioxidant and a food grade aromatic amine antioxidant, said food grade phenolic antioxidant and said food grade aromatic amine antioxidant each being present in said high performance food grade lubricating oil in an effective amount less than about 1.0% by weight.

2. A high performance food grade lubricating oil in accordance with claim 1 wherein said food grade phenolic antioxidant comprises at least one member selected from the group consisting of food grade oil-soluble sterically hindered phenols and food grade oil-soluble sterically hindered thiophenols, and said food grade aromatic amine antioxidant comprises a food grade oil-soluble aromatic amine antioxidant selected from the group consisting of naphthyl phenyl amine, alkylated phenyl naphthyl amine, and alkylated diphenyl amine.

3. A high performance food grade lubricating oil in accordance with claim 1 wherein said food grade poly-(alpha)olefin comprises a food grade poly(alpha olefin) with an alpha olefin monomer of not less than 6 carbon atoms, and said food grade base oil comprises said food grade poly(alpha olefin).

4. A high performance food grade lubricating oil in accordance with claim 1 wherein said lubricating oil has a viscosity ranging from about 10 CS at about 40° C. to about 1000 CS at about 40° C.

5. A high performance lubricating oil in accordance with claim 1 wherein said food grade base oil comprises polybutene and said polybutene is hydrogenated.

6. A high performance food grade lubricating oil in accordance with claim 1 wherein said food grade oil-soluble, sterically hindered phenols have the formula:

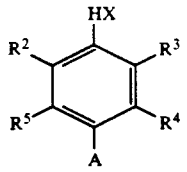

wherein X is sulfur or oxygen, $R^2$ and $R^3$ are alkyl groups having from 3 to 10 carbon atoms, $R^4$ and $R^5$ are the same of different substituents selected from the group consisting of hydrogen and $C_1$ to $C_4$ alkyl, and A is selected from the group consisting of single hindered phenols, hindered bisphenols, hindered 4,4'-thio bisphenols, and 4 alkoxy phenols.

7. A high performance food grade lubricating oil in accordance with claim 1 wherein said food grade phenolic antioxidant comprises at least one member selected from the group consisting of butylated hydroxy toluene and butylated hydroxy anisole substantially complying with USDA H-1 specifications for use in processing plants where incidental contact with food can occur.

8. A high performance food grade lubricating oil in accordance with claim 1 wherein said aromatic amine antioxidant comprises at least one member selected from the group consisting of naphthyl phenyl amines, alkylated diphenyl amines, and alkylated phenyl naphthyl amines having the formula:

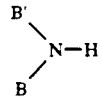

where B and $B^1$ are the same or different substituents selected from the group consisting of:

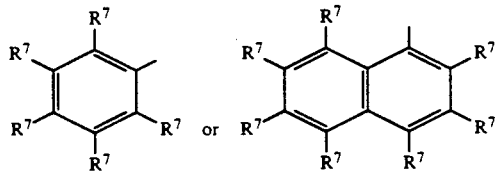

where $R^7$ is the same or different substituents selected from the group consisting of hydrogen and $C_1$ to $C_{18}$ alkyls.

9. A high-performance food grade lubricating oil in accordance with claim 1 wherein said phenolic and aromatic amine antioxidants are present in a ratio by weight ranging from about 20:1 to about 1:20.

10. A high performance food grade lubricating oil in accordance with claim 1 wherein said phenolic and aromatic amine antioxidants are present in a ratio by weight ranging from about 4:1 to about 1:4.

11. A high performance food grade lubricating oil comprising by weight:

a. from about 90% to about 99.9% food grade base oil comprising at least one member selected from the group consisting of food grade mineral oil, food grade polybutene, and food grade hydrogenated poly(alpha olefin) with an alpha olefin monomer of not less than 6 carbon atoms; and b. from about 0.01% to about 10% of a food grade additive package for imparting extreme anti-oxidation, anti-wear, and anti-rust properties, said food grade additive package comprising food grade phenolic and food grade aromatic amine antioxidants, said food grade phenolic and food grade aromatic amine antioxidants each present in an effective amount less than about 1.0% by weight of the food grade lubricating oil and present in said food grade lubricating oil in a ratio by weight ranging from about 20:1 to about 1:20.

12. A high performance food grade lubricating oil in accordance with claim 11 wherein said food grade phenolic antioxidants which can be employed comprise at least one member selected from the group consisting of food grade oil-soluble, sterically hindered phenols and food grade oil-soluble sterically hindered thiophenols, and said food grade aromatic amine antioxidant comprises a food grade oil-soluble aromatic amine antioxidant selected from the group consisting of naphthyl phenyl amine, alkylated phenyl naphthyl amine, and alkylated diphenyl amine.

13. A high performance food grade lubricating oil in accordance with claim 11 wherein said food grade phenolic antioxidant is butylated hydroxy toluene substantially complying with USDA H-1 specifications for use in processing plants where incidental contact with food can occur.

14. A high performance food grade lubricating oil in accordance with claim 11 wherein said food grade additive package is present in an amount ranging from about 0.01% to about 2.0% by weight, said food grade additive package including a food grade ionic surface active anti-wear component and a food grade non-ionic surface active anti-wear component, and said food grade non-ionic surface active anti-wear component comprising at least one member selected from the group consisting of food grade fatty acids and their esters formed from the addition of polyhydric alcohols, food grade fatty acids and their esters formed from the addition of polyalkylene glycols, food grade ethers from alcohols alkoxylated with alkylene oxides, food grade sorbitan alkoxylated with alkylene oxides, and food grade sorbitan esters alkoxylated with alkylene oxides.

15. A high performance food grade lubricating oil in accordance with claim 13 wherein said food grade aromatic amine antioxidant is a food grade alkylated diphenyl amine.

16. A high performance food grade lubricating oil in accordance with claim 13 wherein said food grade phenolic and said food grade aromatic amine antioxidants are present in a ratio by weight ranging from about 4:1 to about 1:4.

17. A high performance food grade lubricating oil, comprising:

a. from about 98% to about 99.8% by weight food grade base oil comprising at least one member selected from the group consisting of food grade mineral oil and food grade polybutene;

b. from about 0.05% to about 2.0% by weight of food grade anti-oxidant additives including a food grade alkylated diphenyl amine antioxidant and food grade butylated hydroxy toluene, said antioxidants being present in a ratio range by weight of about 4:1 to about 1:4; and c. from about 0.01% to about 1.0% by weight of food grade anti-wear and food grade anti-rust additives comprising a food grade ionic surface active anti-rust component and a food grade non-ionic surface active anti-rust component including at least one member selected from the group consisting of fatty acids and their esters formed from the addition of polyhydric alcohols, fatty acids and their acids formed from the addition of polyalkylene glycols, ethers from alcohols alkoxylated with alkylene oxides, sorbitan alkoxylated with alkylene oxides, and sorbitan esters alkoxylated with alkylene oxides.

18. A high performance food grade lubricating oil in accordance with claim 17 wherein said lubricating oil comprises from about 0.5% to about 1.0% by weight of said food grade anti-oxidant additives; said alkylated diphenyl amine antioxidant is bis(octyl phenyl) amine; said ionic surface active anti-rust component is a food grade alkylamine phosphate; and said non-ionic surface active anti-rust component is food grade sorbitan mono-oleate.

19. A high performance food grade lubricating oil in accordance with claim 18 wherein said food grade sorbitan mono-oleate is present in an amount ranging from about 0.01% to about 0.20% by weight of said food grade lubricating oil.

20. A high performance food grade lubricating oil in accordance with claim 19 wherein said food grade anti-wear additive comprises triphenyl phosphorothioate.

* * * * *